United States Patent [19]

Jeter

[11] 4,015,551

[45] Apr. 5, 1977

[54] TUFTING NEEDLE

[75] Inventor: Sheldon M. Jeter, Carlisle, S.C.

[73] Assignee: Milliken Research Corporation, Spartanburg, S.C.

[22] Filed: Mar. 29, 1976

[21] Appl. No.: 671,248

[52] U.S. Cl. ..... 112/222

[51] Int. Cl.[2] ..... D05B 85/10

[58] Field of Search ..... 112/222, 79 R, 79 FF, 112/80, 79.5

[56] References Cited

UNITED STATES PATENTS

| | | | |
|---|---|---|---|
| 1,937,257 | 11/1933 | Van Dyke | 112/80 |
| 1,977,914 | 10/1934 | Morrow | 112/80 |
| 2,728,314 | 12/1955 | Richards | 112/79.5 |
| 3,336,889 | 8/1967 | Short | 112/79 R |
| 3,356,047 | 12/1967 | Short | 112/222 |

*Primary Examiner*—George H. Krizmanich
*Attorney, Agent, or Firm*—H. William Petry; Earle R. Marden

[57] ABSTRACT

A hollow needle for a tufting machine using fluid means to insert the yarn through a backing material. The needle has a fairly sharp point and is ground to merge the walls of the point of the needle into the base diameter to provide a gradual spread of the yarns in the backing material through which the needle is inserted.

2 Claims, 10 Drawing Figures

TUFTING NEEDLE

The object of the invention is to provide a hollow needle tufting machine which will readily enter a backing material and gradually spread the yarns to provide ease of insertion of the needle.

Other objects and advantages of the invention will become readily apparent as the specification proceeds to describe the invention with reference to the accompanying drawings, in which.

Figure 4:
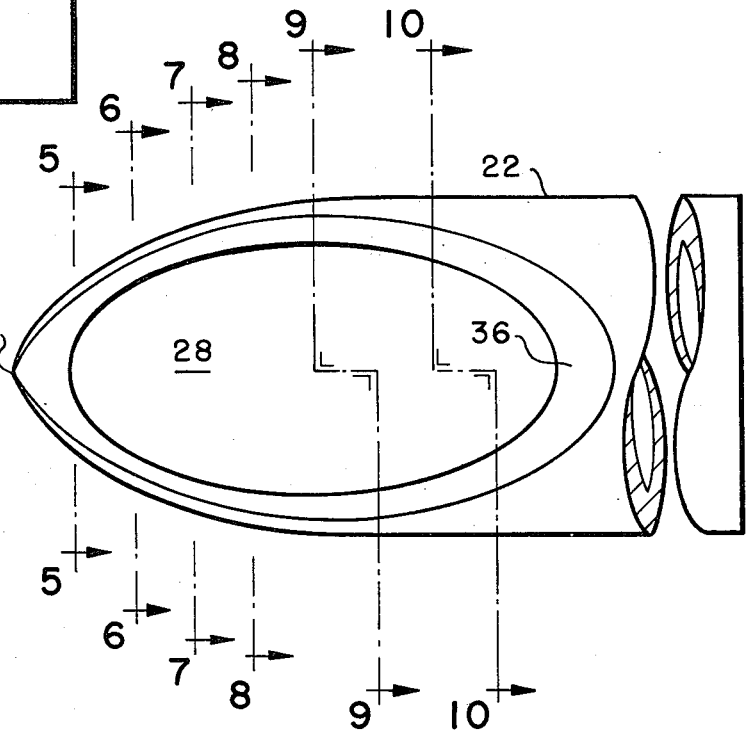
FIG. 4 is an elevational view of the needle shown in FIG. 3.

FIGS. 5-10, respectively, are views taken on lines 5—5 through 10—10 in FIG. 4.

Figure 1:
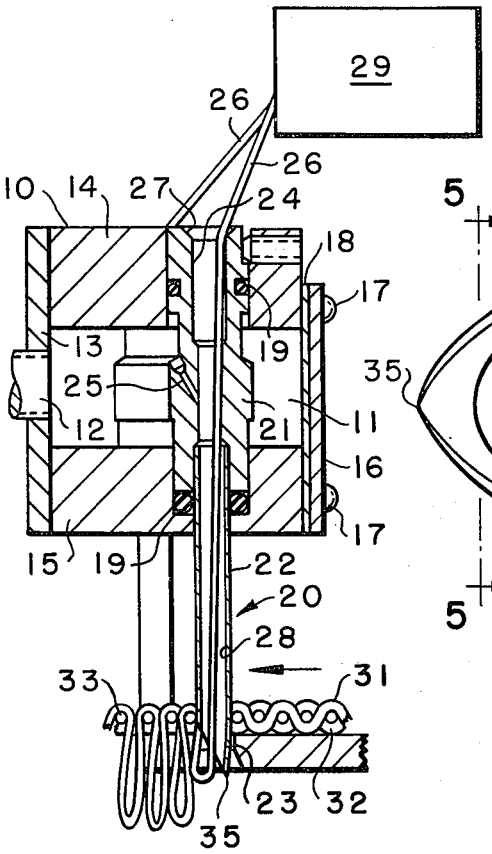
FIG. 1 is a fragmentary, vertical sectional view of a needle bar having mounted therein hollow tufting needles constructed in accordance with the present invention.

Referring now in detail to the embodiment chosen for the purpose of illustrating the present invention, it being understood that, in its broader aspects, the present invention is not limited to the exact details herein depicted, numeral 10 in FIG. 1 denotes a hollow needle bar closed on all sides for defining a chamber 11 to which fluid under pressure, such as compressed air, is fed from a flexible hose (not shown) connected to a pipe 12 extending through the back wall 13 of the needle bar 10. The needle bar 10 includes an upper plate 14 and a lower plate 15 disposed parallel to each other and extending the length of the needle bar 10. The needle bar 10 also includes a front plate 16 which is bolted by bolts 17 to the front edges of plates 14 and 15, the front plate 16 being spaced downwardly with respect to the upper surface of plate 14 and having a gasket 18.

The upper plate 14 and the lower plate 15 are respectively provided with a plurality of staggered holes forming two rows of holes substantially throughout their length, the axes of the holes in upper plate 14 being respectively aligned vertically with the axes of the holes in the lower plate 15. If desired, only a single row or three or more rows of such holes may be provided. The arrangement of needles on a needle bar, however, is well known in the art and therefore no detail discussion of such arrangement is deemed necessary.

Each pair of aligned holes in the upper plate 14 and lower plate 15 receives a needle, denoted generally by the numeral 20. Each needle 20 includes, as seen in FIG. 1, a body 21 and a shank 22 having a yarn discharge end 23. The body 21 and the shank 22, except for the discharge end 23, are identical in construction to the construction of the needle illustrated in U.S. Pat. No. 3,217,676, and, therefore, no detailed description of this hollow needle 10 is deemed necessary, except to state that the body 21 is received in the holes in upper plate 14 and lower plate 15 and has "O" rings 19 to prevent the passage of fluid from the chamber 11 through the holes in plates 14 and 15. The body 21 is bored throughout in length to provide a straight yarn passageway 24 disposed along its axis. In the central portion of body 21 are a plurality of radially spaced fluid passageways 25 which converge downwardly in the direction of discharge of the yarn 26 from the body 21. The fluid passageways 25 communicate at their upper or outer ends with the chamber 11 of the needle bar 10 and communicate at their lower or inner ends with the yarn passageway 24 so that fluid from the chamber 11 may be introduced into the yarn passageway 24 for urging the yarn 26 out of the passageway 24.

The lower end of the body 21 is counterbored to a slightly larger diameter than the diameter of the yarn passageway 24 for receiving the inlet end of shank 22. At the mouth of the yarn passageway 24, the body 21 is chamfered to provide an inwardly and downwardly tapered yarn entrance or inlet 27.

It will be understood that, in the multi-needle tufting machine, a plurality of yarns 26, are fed from a creel (not shown) to a yarn control or yarn feed mechanism 29 and thence along essentially parallel downwardly inclined paths to the respective needles 20. Each yarn 26 passes into the yarn entrance 27 of its associated needle 20, and thence, down through the yarn passageway 24 to the yarn passageway 28. From the yarn passageway 28, the yarn 26 is fed out of the yarn discharge end 23.

The tips 35 of the yarn discharge ends 23 of all needles 20 terminate in essentially a single plane parallel to needle bar 10 and a backing material 31 is disposed beneath the plane of the tips 35. The backing material 31 is fed along a predetermined path, from right to left in FIG. 1, and the needle bar 10 is reciprocated in a vertical path through a small amplitude sufficient to insert the yarn discharge ends 23 through the backing material 31 so as to expose it to the face side of the backing material 31 and then withdraw it from the backing material 31.

The backing material 31 is preferably woven jute having warp yarns 32 and filling yarns 33. Other backing materials, both woven and unwoven, may suggest themselves to those skilled in the art; however, regardless of the type of such backing material, the needle 20 of the present invention should retain its advantages over conventional needles, as hereinafter pointed out in respect to the preferred backing material 31.

Figure 2:
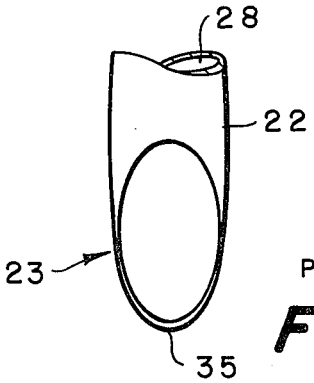
PRIOR ART FIG.-2-
FIG. 2 is an enlarged, rear elevational view of a prior art hollow needle.
Figure 5:
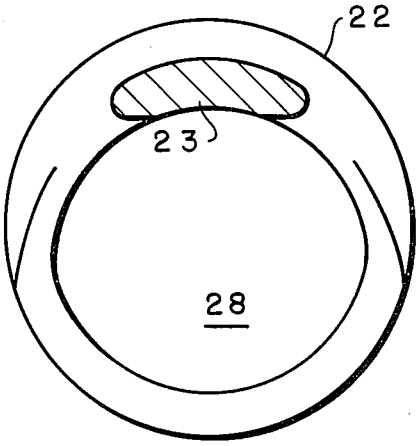
Figure 6:
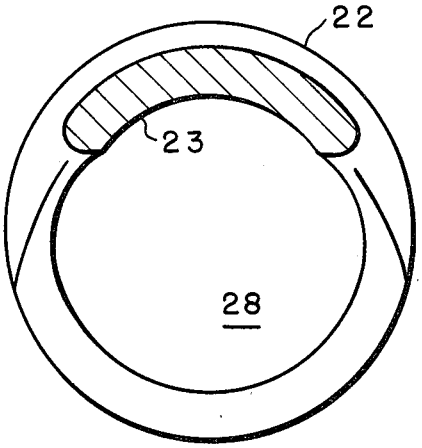
Figure 7:
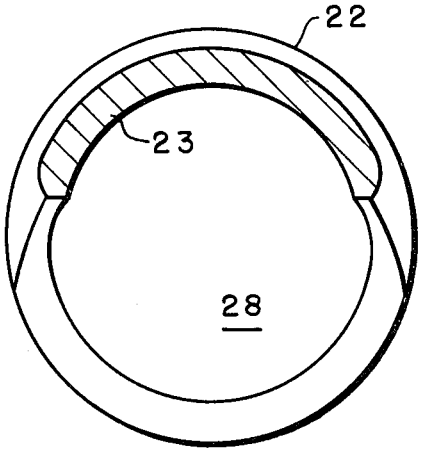
Figure 8:
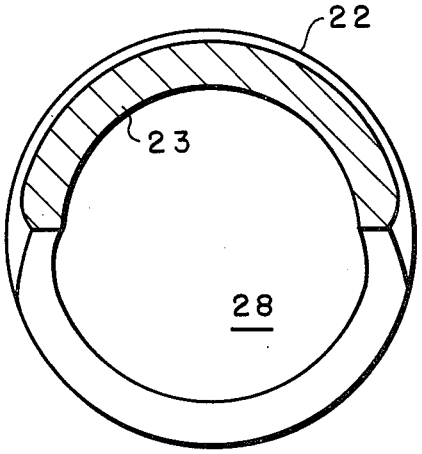
Figure 9:
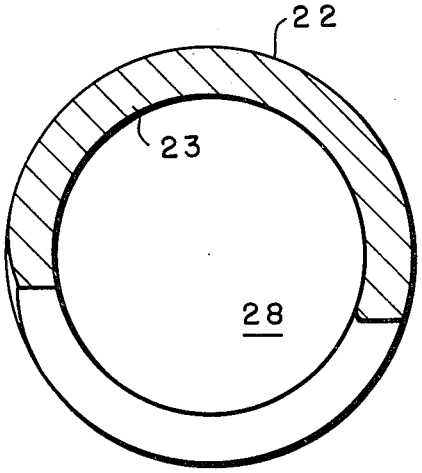

FIG. 2 shows the yarn discharged end of a prior art hollow needle which is produced by cutting in a straight cut, the end position of shank 22, the angle the cut being at approximately 30 degrees to the axis of the shank providing a discharge opening of oval or elliptical shape. The discharge end 23 of the needle is ground to round the tip 35 of the needle but is generally blunt as shown in FIG. 2.

The needle shown in FIG. 2 has been used in production but has certain disadvantages. The blunt point tends to make is difficult to penetrate the backing material and causes tearing of the yarn therein. Therefore, the needle shown in FIGS. 3–10 has been developed to correct the disadvantages of the prior art needles.

Figure 3:
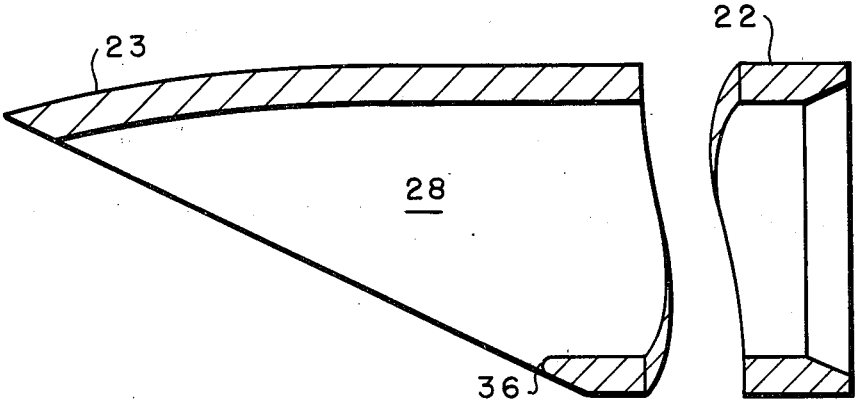
FIG. 3 is a cross-section of the new improved hollow needle.
Figure 10:
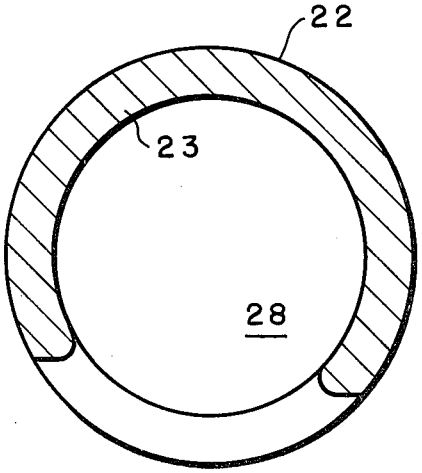

As shown in FIG. 3, the new and improved needle is initially produced like that of FIG. 2 in that the discharge end is cut off at an angle of 30 degrees and the upper or longer surface (FIG. 3) is swagged downwardly. Then to provide a sharper point for penetration of the needle into the backing fabric and to provide gradual separation of the yarns in the fabric, the discharge end 23 of the needle towards the shank 22 is ground at a successively larger radius until it merges with the diameter of the shank of the needle as shown in FIG. 10. FIGS. 5–9 illustrate the shape of the needle progressing towards the shank pointing out that as the grinding radius increases, the curvature of the needle wall decreases. Further, the heel 36 of the needle is rounded to prevent the pinching of the yarn 26 between the needle and the backing material.

It can readily be seen that a hollow tufting needle has been disclosed which will readily penetrate the backing fabric and gradually spread the yarn therein to prevent tearing of the fabric while yarn is being inserted therein through the needle.

Although the preferred embodiment has been described specifically, it is contemplated that changes may be made without departing from the scope or spirit of the invention and it is denied that the invention be limited only by the scope of the claims.

That which is claimed is:

1. A tufting needle comprising a cylindrical shank provided with a cylindrical axial yarn passageway, and means to admit air to said passageway, and means to admit air to said passageway to blow yarn therethrough, said shank being beveled at its lower end, said passageway having a yarn inlet opening at one end and an inclined elliptical shaped yarn discharge opening at its other end defined by the beveled lower end of said shank, said elliptical shaped yarn discharge opening being in axial alignment with said passageway, said beveled lower end of said shank being arcuate in cross section and having a taper extending convexly inwardly, said taper merging smoothly with the remainder of said shank as a circumferential line being ground from the beveled lower end towards the shank with successively larger radii to around said shank near the upper periphery of said elliptical opening so that the length of the taper is greatest on the side of the shank which defines the lower periphery of said elliptical opening and progressively decreases around the shank in both directions from said side, to provide a pointed beveled lower end and a gradual rounded curvature towards the shank.

2. The needle of claim 1 wherein the portion of the elliptical opening adjacent the shank is rounded to prevent pinching of yarn between the needle and a backing material through which the needle is projected.

* * * * *